US010766725B2

(12) United States Patent
Duesterhus

(10) Patent No.: US 10,766,725 B2
(45) Date of Patent: Sep. 8, 2020

(54) DEVICE FOR HANDLING NOTES OF VALUE

(71) Applicant: Wincor Nixdorf International GmbH, Paderborn (DE)

(72) Inventor: Richard Duesterhus, Paderborn (DE)

(73) Assignee: Wincor Nixdorf International GmbH, Paderborn (DE)

( * ) Notice: Subject to any disclaimer, the term of this patent is extended or adjusted under 35 U.S.C. 154(b) by 71 days.

(21) Appl. No.: 16/238,902

(22) Filed: Jan. 3, 2019

(65) Prior Publication Data

US 2019/0206173 A1 Jul. 4, 2019

(30) Foreign Application Priority Data

Jan. 3, 2018 (EP) ..... 18150151

(51) Int. Cl.
*B65H 5/36* (2006.01)
*G07D 11/18* (2019.01)
(Continued)

(52) U.S. Cl.
CPC ..... *B65H 5/36* (2013.01); *B65H 29/52* (2013.01); *G07D 11/10* (2019.01); *G07D 11/12* (2019.01); *G07D 11/14* (2019.01); *G07D 11/18* (2019.01); *G07D 11/26* (2019.01); *B65H 2401/213* (2013.01); *B65H 2402/10* (2013.01); *B65H 2404/611* (2013.01);
(Continued)

(58) Field of Classification Search
CPC ..... B65H 2402/60; B65H 2402/63; B65H 2404/693; B65H 2404/74; B65H 2404/741; B65H 2404/7412; B65H 2515/71; B65H 2555/42; B65H 2701/1912; B65H 2402/10; B65H 2402/5154; B65H 2401/213; G07D 2211/00; G07D 11/14; G07D 11/18; G07D 11/12; G07D 11/10; G07D 11/0096
See application file for complete search history.

(56) References Cited

U.S. PATENT DOCUMENTS 6,695,307 B2 * 2/2004 Kanagawa ..... B65H 29/006 271/207
8,764,011 B2 * 7/2014 Michels ..... G07D 11/10 271/264
(Continued)

FOREIGN PATENT DOCUMENTS

DE 102009038175 A1 2/2011
EP 0547308 A1 6/1993

OTHER PUBLICATIONS

Extended European search report issued in the corresponding European application; 8 pages.

*Primary Examiner* — Jeremy R Severson
(74) *Attorney, Agent, or Firm* — Black, McCuskey, Souers & Arbaugh LPA

(57) ABSTRACT

A device for handling notes of value includes first, second and third modules. The third module has a first guiding element and at least a second guiding element for guiding the notes of value. The first guiding element has at least a first magnet or a ferromagnetic material. The first magnet and a second magnet or the first magnet and the ferromagnetic material are arranged opposite to each other at least in an operating state, an attractive force acting between the first magnet and the second magnet or the first magnet and the ferromagnetic material.

19 Claims, 11 Drawing Sheets

(51) Int. Cl.

| | |
|---|---|
| ***G07D 11/26*** | (2019.01) |
| ***G07D 11/14*** | (2019.01) |
| ***G07D 11/10*** | (2019.01) |
| ***B65H 29/52*** | (2006.01) |
| ***G07D 11/12*** | (2019.01) |

(52) U.S. Cl.
CPC .. *B65H 2404/7412* (2013.01); *B65H 2515/71* (2013.01); *B65H 2555/42* (2013.01); *B65H 2701/1912* (2013.01); *G07D 2211/00* (2013.01)

(56) References Cited

U.S. PATENT DOCUMENTS

| | | | | |
|---|---|---|---|---|
| 10,011,446 | B2 * | 7/2018 | Iwasaki | G07D 11/18 |
| 10,192,385 | B2 * | 1/2019 | Yokote | B65H 5/36 |
| 2017/0206730 | A1 | 7/2017 | Iwasaki et al. | |

* cited by examiner

DEVICE FOR HANDLING NOTES OF VALUE

CROSS-REFERENCE TO RELATED APPLICATIONS

This application claims priority to and the benefit of European Patent Application 18 150 151.1, filed 3 Jan. 2018, the contents of which are hereby incorporated by reference in their entirety.

BACKGROUND AND SUMMARY

This relates to a device for handling notes of value, including a first module and a second module, the first module and the second module each having a transport mechanism for transporting notes of value. Further, the device includes a third module including a first guiding element and at least a second guiding element for guiding the notes of value. In one operating state of the device, the notes of value are guided by the guiding elements of the third module during the transport from the first module to the second module and/or from the second module to the first module, wherein in this operating state the guiding elements are oriented in an operating position for guiding the notes of value.

Known automated teller machines include a safe in which cash boxes filled with banknotes are receivable. The safe has an opening through which banknotes removed from the cash boxes are feedable from the safe to a head module and/or deposited banknotes are feedable from the head module to the safe. The head module in particular includes an input and output module, by which banknotes to be dispensed to a user are output and/or banknotes to be deposited by the user are accepted. Both the head module and the safe each include a transport mechanism for transporting the notes of value. For a reliable transfer of the notes of value between the safe and the head module the safe includes two guiding elements, between which the notes of value are guided during the transport from the safe to the head module and/or from the head module to the safe. The guiding elements project from the safe toward the head module, and in particular into the head module. For assembly, disassembly and maintenance, the head module is in particular designed such that it is movable out of the automated teller machine relative to the safe.

From document DE 102009038175 A1, a device for handling notes of value is known, in which guiding elements project from the safe into the head module in an operating position and in which the head module and the safe module are movable relative to each other in an easy and space-saving manner. The guiding elements are held in the operating position by one spring each. When moving the modules relative to each other, the guiding elements are rotated by the contact with the first module against the spring force of the springs about axes of rotation of the guiding elements toward the second module and are thus folded down. The guiding elements are folded down only as long as the first module contacts the guiding elements. When there is no contact between the first module and the guiding elements, the guiding elements again assume their operating position due to the spring force of the springs. The springs, however, are subject to wear so that in practice a correct orientation of the guiding elements in their operating position is not always guaranteed. Also in the case of different spring forces and/or different spring constants as a result of manufacturing tolerances a correct orientation of the guiding elements in their operating position is not always guaranteed.

In at least one embodiment, a device for handling notes of value, provides an easy and reliable manner for orientation of guiding elements in the operation position.

According to at least one embodiment, the first guiding element includes at least a first magnet and the second guiding element includes at least a second magnet or a ferromagnetic material. The first magnet and the second magnet or the first magnet and the ferromagnetic material are arranged opposite to each other at least in the operating state, an attractive force acting between the first magnet and the second magnet or the first magnet and the ferromagnetic material. As a result, a reliable and correct orientation of the guiding elements in the operating position is achieved. Hereby, it is in particular prevented that the guiding elements are moved out of the operating position inadvertently, for example due to the forces developed by the banknotes transported between them.

In an advantageous embodiment, a first elastically deformable element is provided, which exerts a holding force on the first guiding element for holding the first guiding element in the operating position for guiding the notes of value. Further, a second elastically deformable element is provided which exerts a holding force on the second guiding element for holding the second guiding element in the operating position for guiding the notes of value. Thus, the holding force of the elastically deformable elements acts in addition to the magnetic attractive force so that a particularly safe and reliable orientation of the guiding elements in the operating position is guaranteed.

It is particularly advantageous when the first guiding element is arranged so as to be rotatable about a first axis of rotation coinciding with its longitudinal axis, and when the second guiding element is arranged so as to be rotatable about a second axis of rotation coinciding with its longitudinal axis. Thus, it is achieved that, when moving the modules to each other, the guiding elements are rotated about the respective axis of rotation and are thus folded down or pivoted. In this way, when moving the modules, no elastic deformation of the guiding elements is required so that material fatigue and other material damages are prevented.

Further, it is advantageous when at least a portion of the first guiding element that is arranged in the operating position projects into the first module and/or when at least a portion of the second guiding element that is arranged in the operating position projects into the first module. In this way, the reliability of the guidance of the notes of value during the transport between the first and the third module is increased.

In an advantageous embodiment, the first magnet is connected to a first lever including a first positioning element or the first lever including the first positioning element is the first magnet. Further, the second magnet or the ferromagnetic material is connected to a second lever including a second positioning element or the second lever including the second positioning element is made of a ferromagnetic material or the second lever including the second positioning element is the second magnet. The first positioning element and the second positioning element are arranged and designed such that in the operating position of the guiding elements the first and the second positioning element are engaged. This engagement has the effect that an additional force is required to move the guiding elements out of their operating position so that a particularly safe and reliable orientation of the guiding elements in the operating position is guaranteed.

It is particularly advantageous when the second module and the third module form a module unit and when the first module is movable relative to the module unit in at least one direction and/or the module unit is movable relative to the first module in at least one direction. The second module and the third module thus form an assembly referred to as module unit and during normal use or normal operation of the device they are handled jointly and in particular are not separated. Upon a relative movement between the first module and the module unit at least a portion of the first guiding element and/or a portion of the second guiding element are rotated about their respective axis of rotation by the contact with the first module such that the guiding elements at least temporarily contact a surface of the first module facing the module unit. As a result, the first module and the module unit can be moved relative to each other without a free space having to be provided for this within the first module so that upon a movement of the first module and the module unit relative to each other the guiding elements do not get caught and thus prevent the relative movement. Further, the first module can be assembled and disassembled easily so that the transport mechanism of the first module is easily accessible for maintenance work, in particular for removing banknote jams.

Further, it is advantageous when a force is exerted at least temporarily on the first and/or the second guiding element upon a relative movement between the first module and the module unit, said force acting against the holding force of the elastically deformable element, against the magnetic attractive force and against the holding force developed by the engagement of the positioning elements. As a result, a reliable positioning and orientation of the guiding elements in the operating state is guaranteed.

In an advantageous embodiment, the third module further includes a third guiding element and a fourth guiding element. In the operating state, at least a portion of the first guiding element and at least a portion of the second guiding element project into the first module, and at least a portion of the third guiding element and at least a portion of the fourth guiding element project into the second module. In the operating state, the first guiding element, the second guiding element, the third guiding element and the fourth guiding element are oriented in the operating position. Thus, the reliability of the guidance of the notes of value during the transport between the modules is increased.

It is particularly advantageous when the third guiding element is arranged so as to be rotatable about a third axis of rotation coinciding with its longitudinal axis and when the fourth guiding element is arranged so as to be rotatable about a fourth axis of rotation coinciding with its longitudinal axis. In this way, it is achieved that also the third guiding element and the fourth guiding element can be rotated about the respective axis of rotation and can be folded down when the module unit and the first module are moved relative to each other, wherein material fatigue and other material damages are prevented.

In a particularly preferred embodiment, a third elastically deformable element is provided which exerts a holding force on the third guiding element for holding the third guiding element in the operating position of the guiding elements. Further, a fourth elastically deformable element is provided which exerts a holding force on the fourth guiding element for holding the fourth guiding element in the operating position of the guiding elements. The third guiding element includes at least a third magnet and the fourth guiding element includes at least a fourth magnet or a second ferromagnetic material. The third magnet and the fourth magnet or the third magnet and the second ferromagnetic material are arranged opposite to each other at least in the operating state, an attractive force acting between the third magnet and the fourth magnet or between the third magnet and the second ferromagnetic material. In this way, it is achieved that the holding force of the third and of the fourth elastically deformable element and the magnetic attractive force of the third magnet and the fourth magnet or of the third magnet and the second ferromagnetic material act in addition to the holding force of the first and the second elastically deformable element and to the magnetic attractive force of the first magnet and the second magnet or of the first magnet and the first ferromagnetic material so that a particularly safe orientation of the guiding elements in the operating position is guaranteed.

Further, it is advantageous when the one operating state is a first operating state of the device and when a further operating state of the device is provided, in which the first module and the module unit are moved relative to each other such that no note of value can be transported from the first module into the second module and/or from the second module into the first module, wherein the first guiding element and the second guiding element automatically orient themselves in the operating position in the further operating state of the device. In this instance, automatic orientation of the guiding elements is that the guiding elements orient themselves in the operating position without any actuating elements. This reduces the error rate and saves installation space.

In a particularly advantageous embodiment, the third magnet is connected to a third lever including a third positioning element or the third lever including the third positioning element is the third magnet. Further, the fourth magnet or the ferromagnetic material is connected to a fourth lever including a fourth positioning element or the fourth lever including the fourth positioning element is made of a ferromagnetic material, or the fourth lever including the fourth positioning element is the fourth magnet. The third positioning element and the fourth positioning element are further arranged and designed such that in the operating position the third and the fourth positioning element are engaged. By engagement of the positioning elements, a holding force in addition to the magnetic attractive force and/or in addition to the holding force of the elastically deformable elements is provided so that a particular safe and reliable orientation of the guiding elements in the operating position is guaranteed.

In an alternative embodiment it is further advantageous when the first module and the third module form a module unit. The first module and the third module thus form an assembly referred to as module unit and during normal use or normal operation of the device they are handled jointly and in particular are not separated. It is particularly advantageous when the second module is movable relative to the module unit in at least one direction and/or the module unit is movable relative to the second module in at least one direction. Upon a relative movement between the second module and the module unit, at least a portion of the third guiding element and a portion of the fourth guiding element are rotated toward the module unit by the contact with the second module such that the third and the fourth guiding element at least temporarily contact a surface of the second module facing the module unit. As a result, the second module and the module unit can be moved relative to each other without a free space having to be provided for this within the second module so that upon a relative movement between the second module and the module unit the guiding elements do not get caught and thus do not prevent the relative movement. Further, the second module can easily be assembled and disassembled so that the transport mechanism of the second module is easily accessible for maintenance work, and in particular for removing banknote jams.

It is particularly advantageous when the first magnet, the second magnet, the third magnet and/or the fourth magnet are permanent magnets. This makes a particularly simple and cost-efficient structure of the device possible.

Further, it is advantageous when the first magnet, the second magnet, the third magnet and/or the fourth magnet are electromagnets. This guarantees a particularly reliable operation of the device. Further, the electromagnets can be controlled such that the electromagnets generate the attractive force only at certain points in time, in particular only in the first operating state.

It is particularly advantageous when the elastically deformable elements are springs, in particular tension springs. The springs are in particular biased so that the guiding elements are safely held in their operating position.

It is further particularly advantageous when the first guiding element is connected to a first shaft in a rotationally fixed manner, the second guiding element is connected to a second shaft in a rotationally fixed manner, the third guiding element is connected to a third shaft in a rotationally fixed manner and the fourth guiding element is connected to a fourth shaft in a rotationally fixed manner, and when the first, the second, the third and the fourth shaft include engagement elements with which connecting elements, in particular eyelets of the elastic elements engage. It is particularly advantageous when the first elastic element is a tension spring with two connecting elements, wherein the first connecting element engages with the engagement element of the first shaft and the second connecting element engages with the engagement element of the third shaft, and/or when the second elastic element is a tension spring with two connecting elements, wherein the first connecting element engages with the engagement element of the second shaft and the second connecting element engages with the engagement element of the fourth shaft. In this way, installation space can be saved. Further, in a particularly advantageous embodiment two elastic elements are sufficient to reliably hold four shafts and thus the guiding elements connected to the shafts in the operating position.

Various aspects will become apparent to those skilled in the art from the following detailed description and the accompanying drawings.

DETAILED DESCRIPTION

Figure 1:
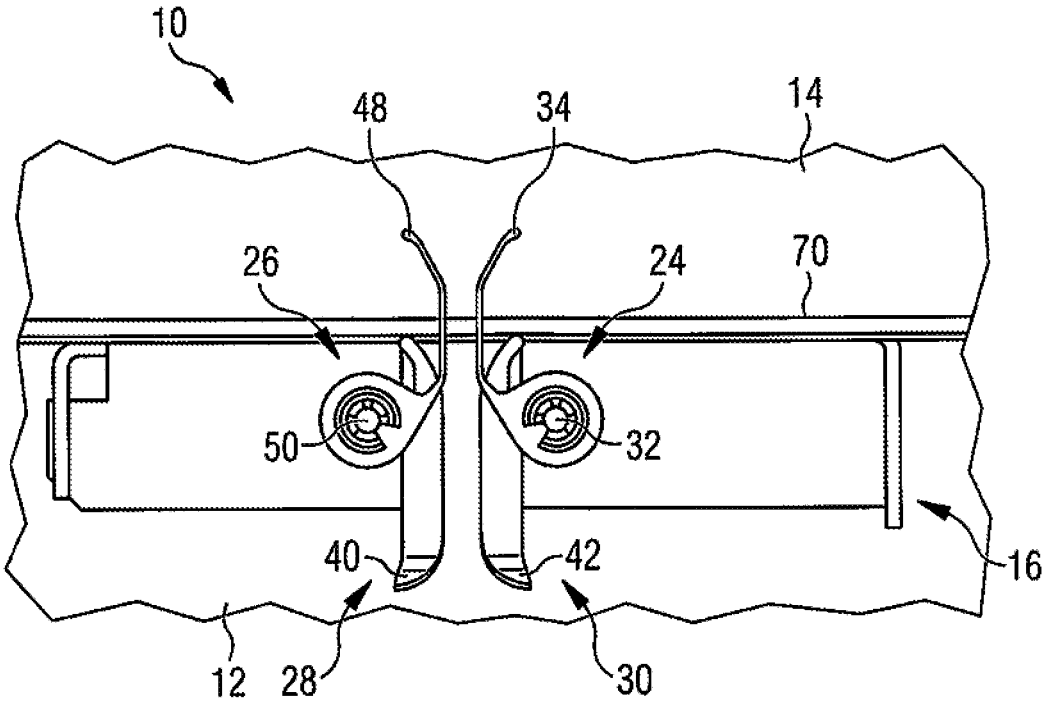
FIG. 1 shows a schematic side view of a detail of a device for handling notes of value according to a first embodiment in a first operating state.

FIG. 1 shows a schematic side view of a detail of a device 10 for handling notes of value according to a first embodiment in a first operating state. The device 10 for handling notes of value includes a safe 12, a head module 14 and a transfer module 16. In the safe 12, several non-illustrated cash boxes for receiving notes of value are receivable.

The head module 14 includes a non-illustrated input and output unit for the output of notes of value to be dispensed to a user and for the input of notes of value deposited by a user. Both the safe 12 and the head module 14 each have an opening through which notes of value can be transported from the head module 14 into the safe 12 and vice versa from the safe 12 into the head module 14. The safe 12 includes a non-illustrated transport mechanism which connects the opening of the head module 14 to the input and output unit. The transport mechanism of the safe 12 connects the cash boxes received in the safe 12 to the opening of the safe 12.

In an alternative embodiment, the device 10 may also only serve to dispense notes of value. In this case, notes of value are only feedable from the safe 12 via the opening of the safe 12 and the opening of the head module 14 to the head module 14. In a further alternative embodiment, the safe 12 and the head module 14 may also be a safe 12 and a head module 14 of an automatic cash register system or an automatic cash safe.

In the first operating state of the device 10, illustrated in FIG. 1, the safe 12 and the head module 14 are arranged relative to each other such that the opening of the safe 12 and the opening of the head module 14 are opposite to each other so that notes of value are transportable between the safe 12 and the head module 14. The transfer module 16 serves to guide the notes of value during the transfer of the banknotes from the head module 14 to the safe 12 and from the safe 12 to the head module 14, respectively.

The transfer module 16 includes a first guiding element 24 and a second guiding element 26 for guiding the notes of value during the transport of banknotes from the safe 12 to the head module 14 and from the head module 14 to the safe 12. The notes of value are transported between the guiding elements 24, 26 so that the notes of value are guided on both sides by one guiding element 24, 26 each.

The first guiding element 24 includes a shaft 32 and eight guiding fingers connected to the shaft 32 in a rotationally fixed manner, one of which being exemplarily identified with the reference sign 34. The second guiding element 26 includes a shaft 50 and eight guiding fingers connected to the shaft 50 in a rotationally fixed manner, one of which being exemplarily identified with the reference sign 48. In an alternative embodiment, the guiding element 24, 26 may also include more or less than eight guiding fingers 34, 48. The guiding fingers 34, 48 of the guiding elements 24, 26 are in particular identically formed. In a further alternative embodiment, the guiding element 24, 26 may also include a continuous plate-shaped element with longitudinal ribs for guiding the banknotes instead of a plurality of guiding fingers 34, 48.

The guiding elements 24, 26 further include at least one first lever 28, 30 each. On the lever 28 a first magnet 40 and on the lever 30 a second magnet 42 is arranged. An attractive force between the two magnets 40 and 42 acts such that the guiding elements 24, 26 are held in the first operating position shown in FIG. 1. In this first operating position, the guiding fingers 34, 48 are put upright and notes of value can be transported between the safe 12 and the head module 14. In the first operating position, at least a portion of each of the guiding fingers 34, 48 projects into the head module 14.

Figure 2:
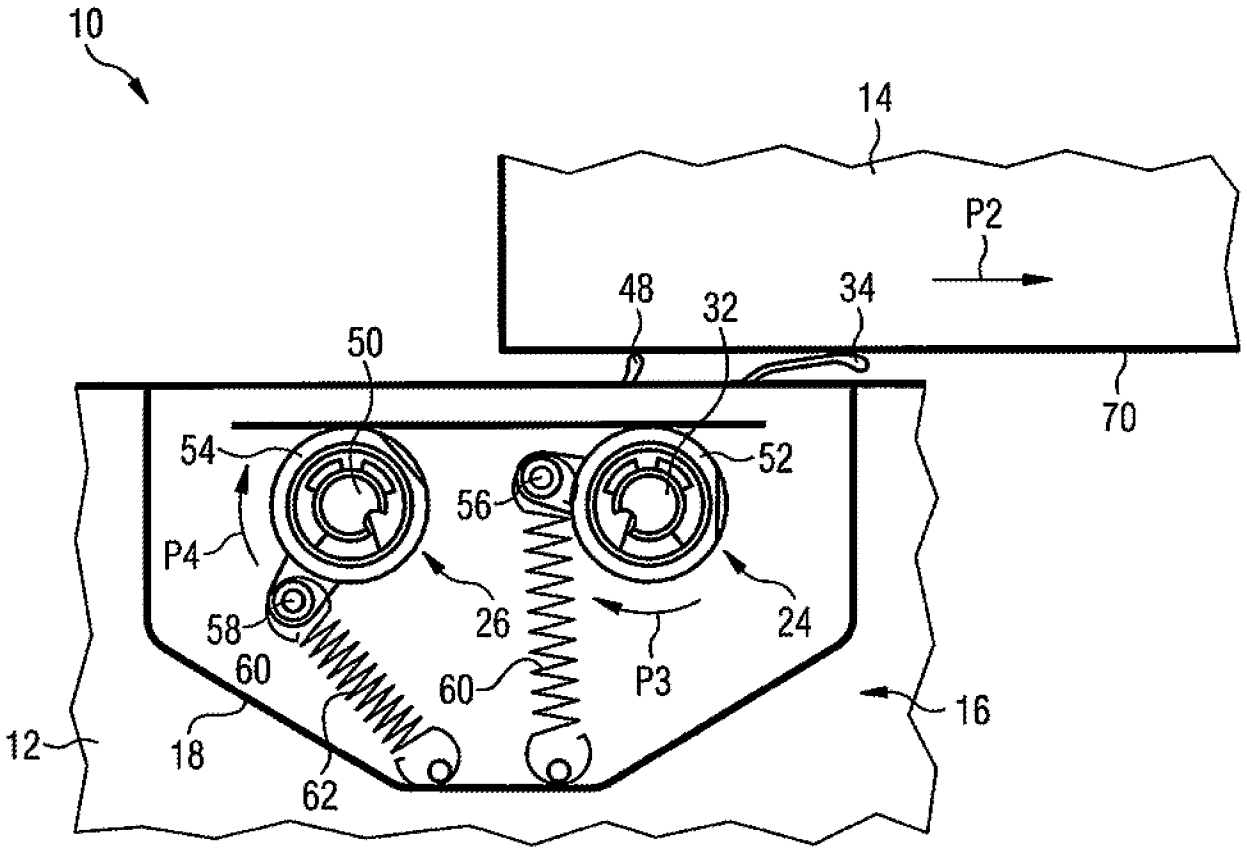
FIG. 2 shows a further schematic side view of the device according to FIG. 1 in a second operating state.

FIG. 2 shows a further schematic sectional illustration of the device 10 for handling notes of value in a second operating state. At the end portion of the shafts 32, 50, one second lever 52, 54 each is arranged which is connected to the shaft 32, 50 in a rotationally fixed manner. The second levers 52, 54 each include an engagement element 56, 58, which is respectively engaged with a first end of a tension spring 60, 62. The second ends of the tension springs 60, 62 opposite to the first ends are firmly connected to a housing unit 18 of the transfer module 16. The force of the tension springs 60, 62 holds the guiding elements, in addition to the magnetic attractive force of the magnets 40, 42, in the first operating position. In particular, in the first operating position of the guiding elements 24, 26 or the levers 28, 30, 52, 54, respectively, the tension springs 60, 62 are arranged in the device 10 in a slightly biased manner.

In the second operating state illustrated in FIG. 2, the head module 14 has been moved relative to the safe 12 in the direction P2. In doing so, the guiding fingers 34, 48 have been rotated about the axes of rotation of the shafts 32 and 50 in the direction of the arrow P2 such that they no longer project into the head module 14. Here, the guiding fingers 34, 48 are in particular folded down such that they contact the surface 70 of the head module 14 facing the safe 12 and in particular rub against this surface 70. When folding down the guiding fingers 34, 48, the guiding elements 24, 26 are rotated against the spring forces of the tension springs 60, 62 and against the magnetic attractive force of the magnets 40, 42. In doing so, the shafts 32, 50 are rotated in the direction of the arrows P3 and P4.

In a third operating state, the head module 14 no longer contacts the guiding elements 24, 26 so that these automatically move into their operating position.

Figure 3:
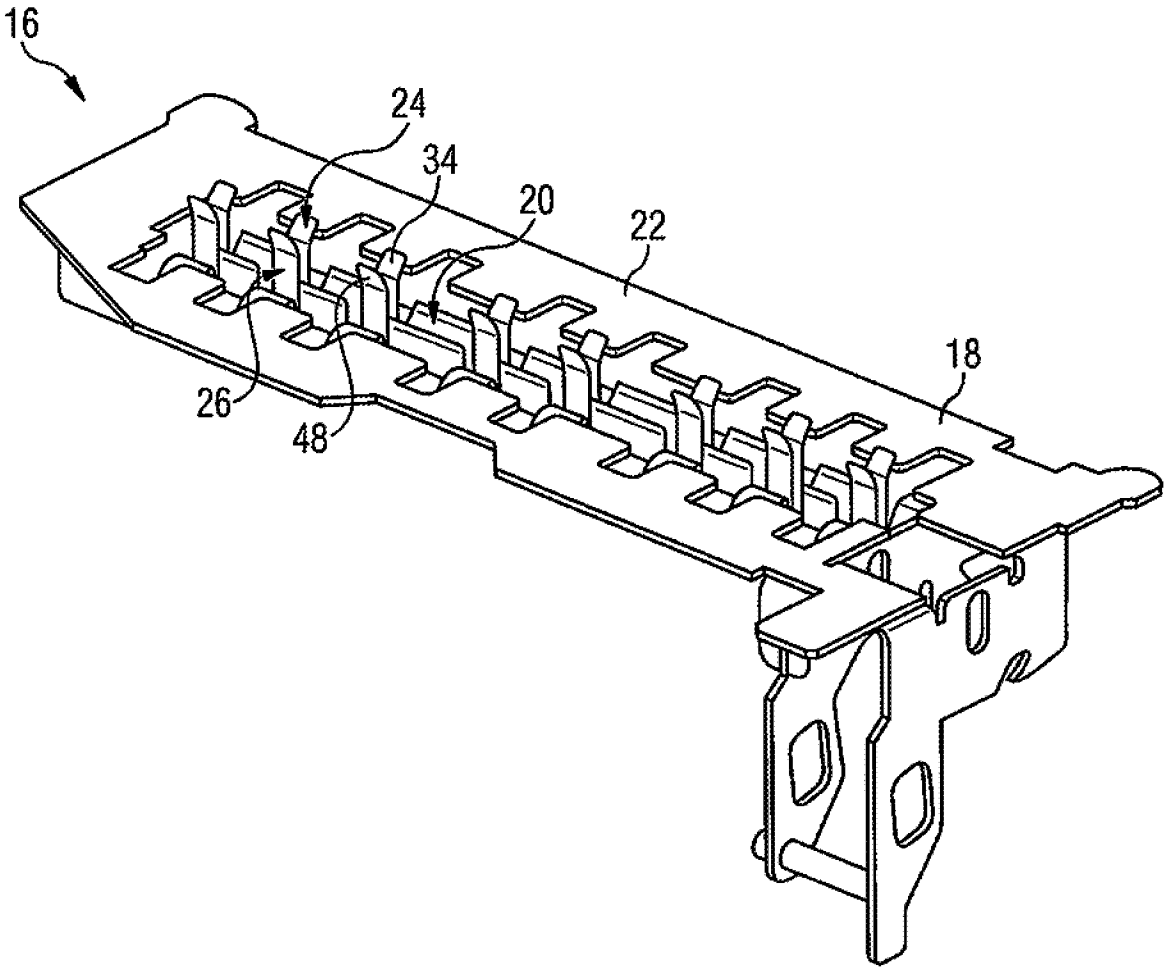
FIG. 3 shows a schematic perspective illustration of a transfer module of the device according to FIGS. 1 and 2.

FIG. 3 shows a schematic perspective illustration of the transfer module 16 according to FIGS. 1 and 2. The transfer module 16 is inserted into the opening of the safe 12 and includes the housing unit 18 which is firmly connected to the safe 12. In the present embodiment, the transfer module 16 and the safe 12 form an assembly, which can be handled as a whole. In other embodiments, the transfer module 16 and the head module 14 may form an assembly, which can be handled as a whole. The housing unit 18 has a cover element 22 having a slot 20 and by which the opening of the safe 12 is at least partially covered. The notes of value are transported through the slot 20 during the transport from the safe 12 to the head module 14 and from the head module 14 to the safe 12. The notes of value are in particular transported in such an orientation that their long side is oriented transversely to the transport direction, i.e. in a so-called "long side first" orientation.

Figure 4:
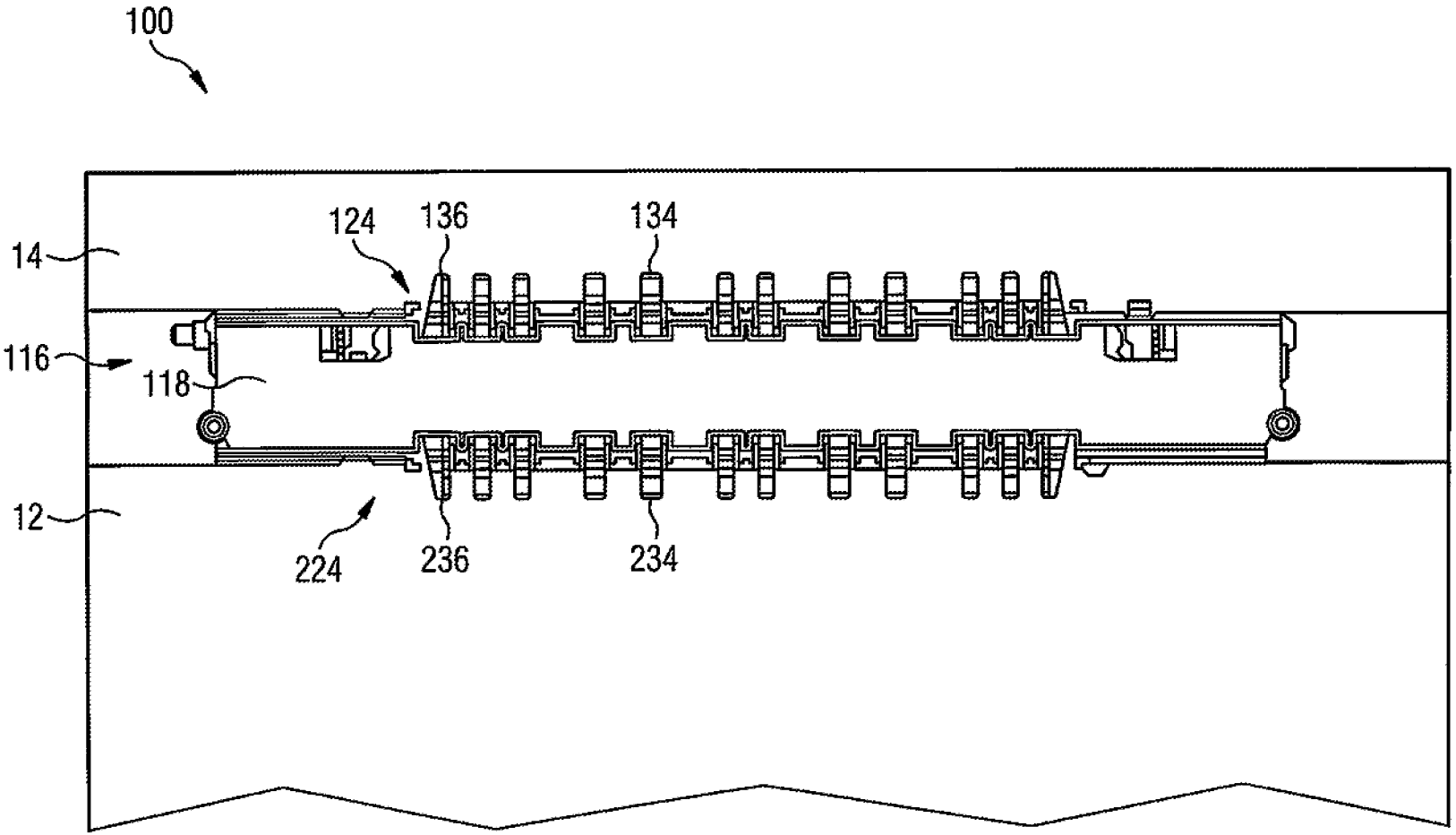
FIG. 4 shows a side view of a device for handling notes of value according to a second embodiment in a first operating state.

FIG. 4 shows a side view of a device 100 for handling notes of value according to a second embodiment in a first operating state. Elements having the same structure or the same function are identified with the same reference signs. The device 100 includes a transfer module 116, a head module 14 and a safe 12. A first upper guiding element 124 of the transfer module 116 projects into the head module 14 and a first lower guiding element 224 of the transfer module 116 projects into the safe 12. Further, the device 100 includes a second upper guiding element 126 and a second lower guiding element 226 which, in the illustration according to FIG. 4, are each covered by the first upper guiding element 124 and the first lower guiding element 224, respectively. Each guiding element 124, 224, 126, 226 includes twelve guiding fingers, four of which are exemplarily identified with the reference signs 134, 234, 136 and 236 in FIG. 4. The outer guiding fingers 136, 236 have a geometry different than that of the inner guiding fingers 134, 234.

Figure 5:
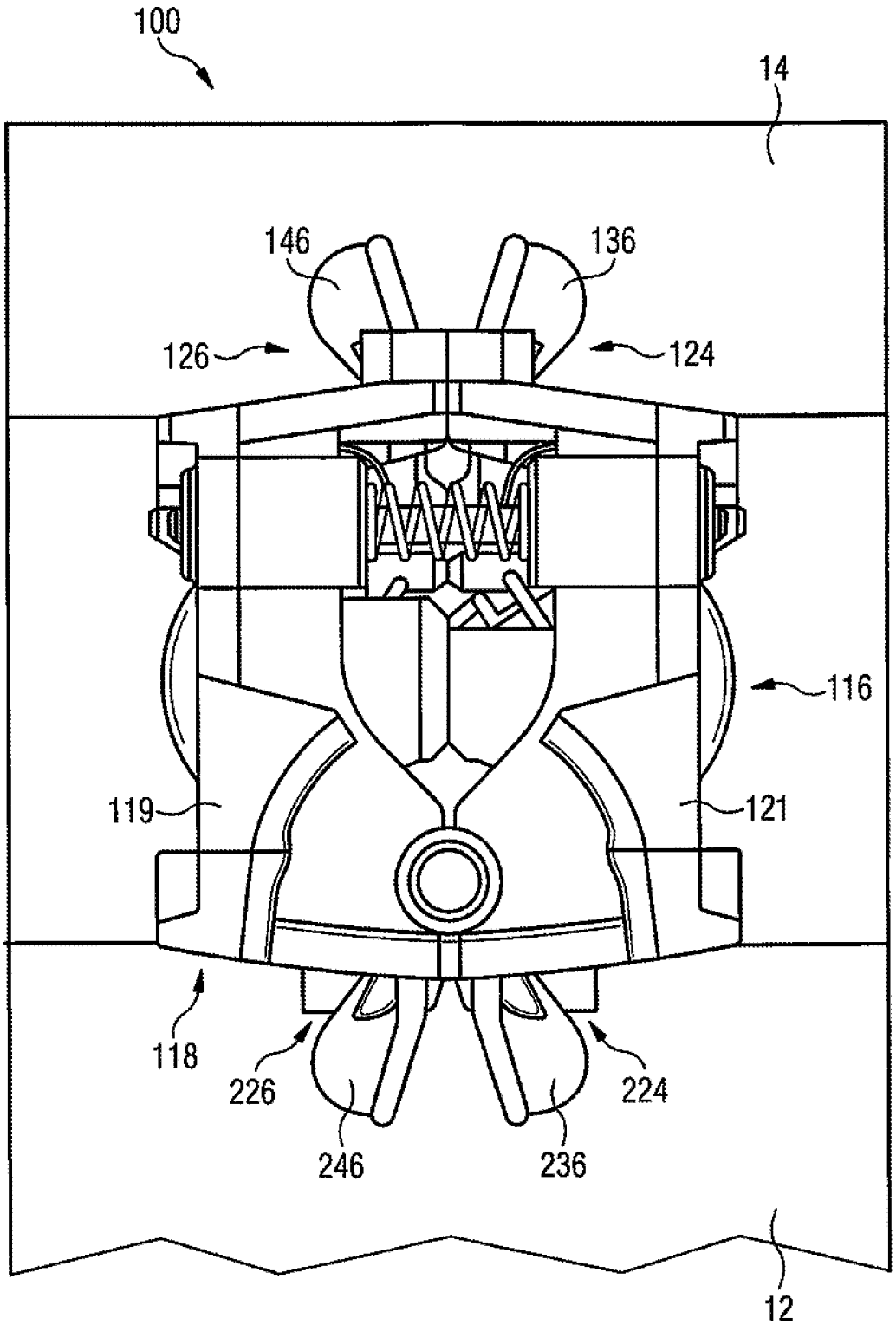
FIG. 5 shows a front view of the device according to FIG. 4.

FIG. 5 shows a front view of the device 100 according to FIG. 4. A housing unit 118 includes two housing elements 119 and 121 firmly connected to each other via a snap-in and/or screw connection. The first upper guiding element 124 and the first lower guiding element 224 are arranged in the first housing element 121, the second upper guiding element 126 and the second lower guiding element 226 are arranged in the second housing element 119 and each time oriented in their operating position. In the operating position, at least one portion each of the guiding fingers 136, 146 projects into the head module 14 and at least one portion each of the guiding fingers 236, 246 projects into the safe 12.

Figure 6:
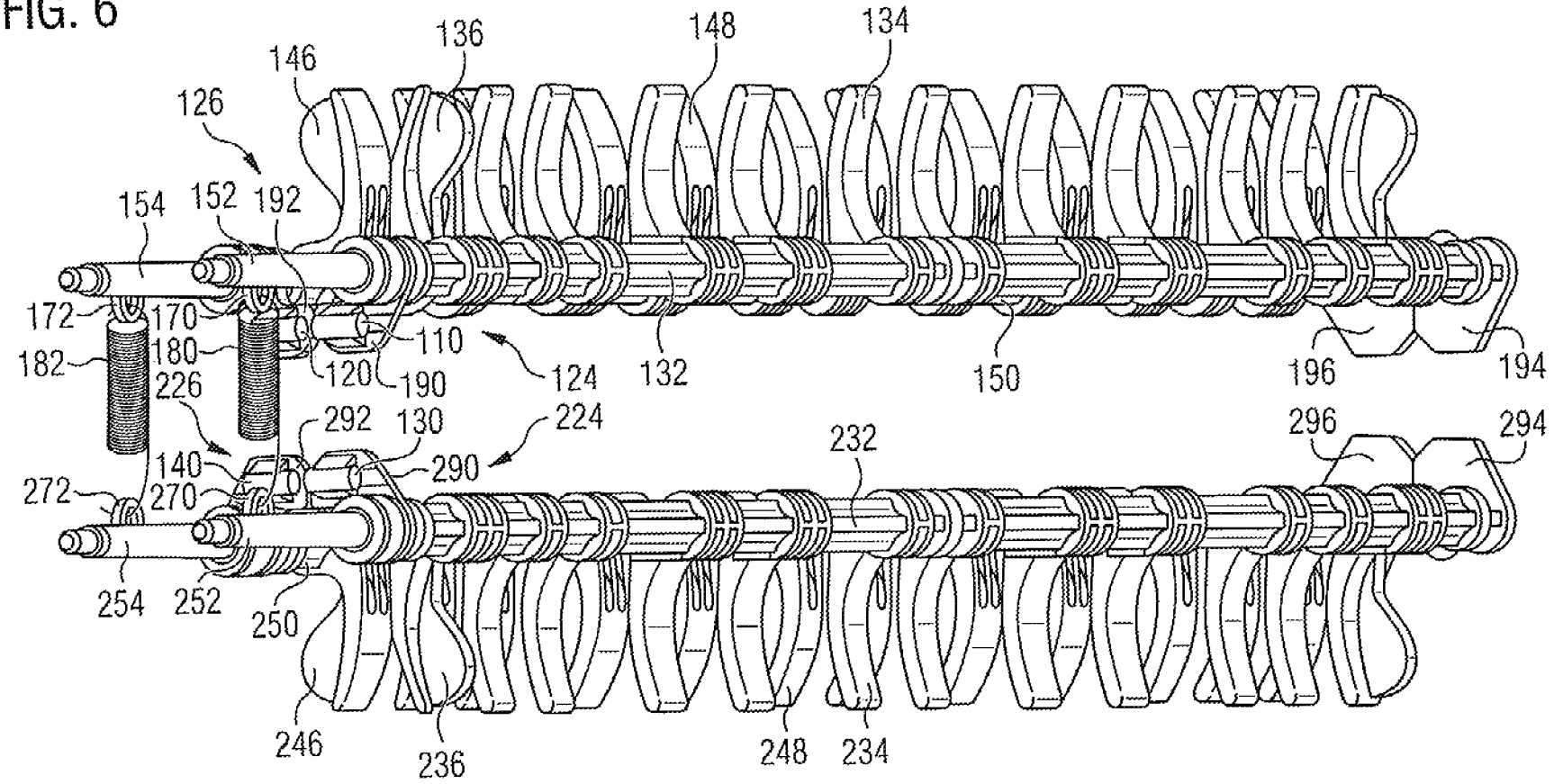
FIG. 6 shows a perspective view of guiding elements of the device according to FIGS. 4 and 5.

FIG. 6 shows a perspective view of an arrangement of the guiding elements 124, 126, 224, 226 of the device 100 according to FIGS. 4 and 5. Each guiding element 124, 126, 236, 246 includes twelve guiding fingers, each time two guiding fingers 134, 148, 234, 248, 136, 146, 236, 246 per guiding element 124, 126, 224, 226 being exemplarily identified with one reference sign. The guiding fingers 134, 136 are connected to a shaft 132 in a rotationally fixed manner, the guiding fingers 146, 148 are connected to a shaft 150 in a rotationally fixed manner, the guiding fingers 234, 236 are connected to a shaft 232 in a rotationally fixed manner and the guiding fingers 246, 248 are connected to a shaft 250 in a rotationally fixed manner.

At the end section of the shafts 132, 150, 232, 250 one lever 152, 154, 252, 254 each is arranged which is connectable to the shaft 132, 150, 232, 250 in a rotationally fixed manner. In the depiction according to FIG. 5 the levers 152, 154, 252, 254 are mounted on the respective shafts 132, 150, 232, 250 and thus connected with the shafts 132, 150, 232, 250 in a rotationally fixed manner. The levers 152, 154, 252, 254 each include an engagement element 170, 172, 270, 272. A first tension spring 180 engages with the engagement element 170 of the lever 152 and with the engagement element 270 of the lever 252. A second tension spring 182 engages with the engagement element 172 of the lever 154 and with the engagement element 272 of the lever 254. In this way, it is achieved that the first upper guiding element 124 and the first lower guiding element 224 are held in their respective operating position by the tension spring 180 and that the second upper guiding element 126 and the second lower guiding element 226 are held in their respective operating position by the tension spring 182.

The shaft 132 includes at a first end a lever 190 and at a second end a lever 194, the shaft 150 includes at a first end a lever 192 and at a second end a lever 196, the shaft 232 includes at a first end a lever 290 and at a second end a lever 294, and the shaft 250 includes at a first end a lever 292 and at a second end a lever 296. The levers 190, 192, 194, 196, 290, 292, 294, 296 are arranged outside a value note transport path defined by the guiding elements 124, 126, 224, 226. In other embodiments, the levers 190, 192, 194, 196, 290, 292, 294, 296 are not arranged at the end but in an area between the end of the shafts 132, 150, 232, 250 and the guiding elements 124, 126, 224, 226.

In an alternative embodiment, the engagement elements 170, 172, 270, 272 of the tension springs 180, 182 may be directly mounted on the shaft 132, 150, 232, 250 or on the levers 190, 192, 194, 196, 290, 292, 294, 296.

A first magnet 110 is firmly connected to the lever 190, a second magnet 120 is firmly connected to the lever 192, the first magnet 110 and the second magnet 120 being arranged opposite to each other so that an attractive force between the first magnet 110 and the second magnet 120 acts and holds the guiding elements 124 and 126 in their operating position.

A third magnet 130 is firmly connected to the lever 290, a fourth magnet 140 is firmly connected to the lever 292, the third magnet 130 and the fourth magnet 140 being arranged opposite to each other so that an attractive force acts between the third magnet 130 and the fourth magnet 140 and holds the guiding elements 224 and 226 in their operating position.

The levers 194 and 196 likewise each include a magnet, which is not visible in the illustration according to FIG. 6, these two magnets being arranged opposite to each other and their attractive force acting in addition to the attractive force of the first magnet 110 and the second magnet 120. Further, the levers 294 and 296 likewise each include a magnet, which is not visible in the illustration according to FIG. 6, these two magnets being arranged opposite to each other and their attractive force acting in addition to the attractive force of the third magnet 130 and the fourth magnet 140.

The attractive forces of the magnets 110, 120, 130, 140 act in addition to the spring forces of the springs 180, 182 so that the operating position of the guiding elements 124, 126, 224, 226 is held at least by the magnetic attractive forces and the spring forces.

Figure 7:
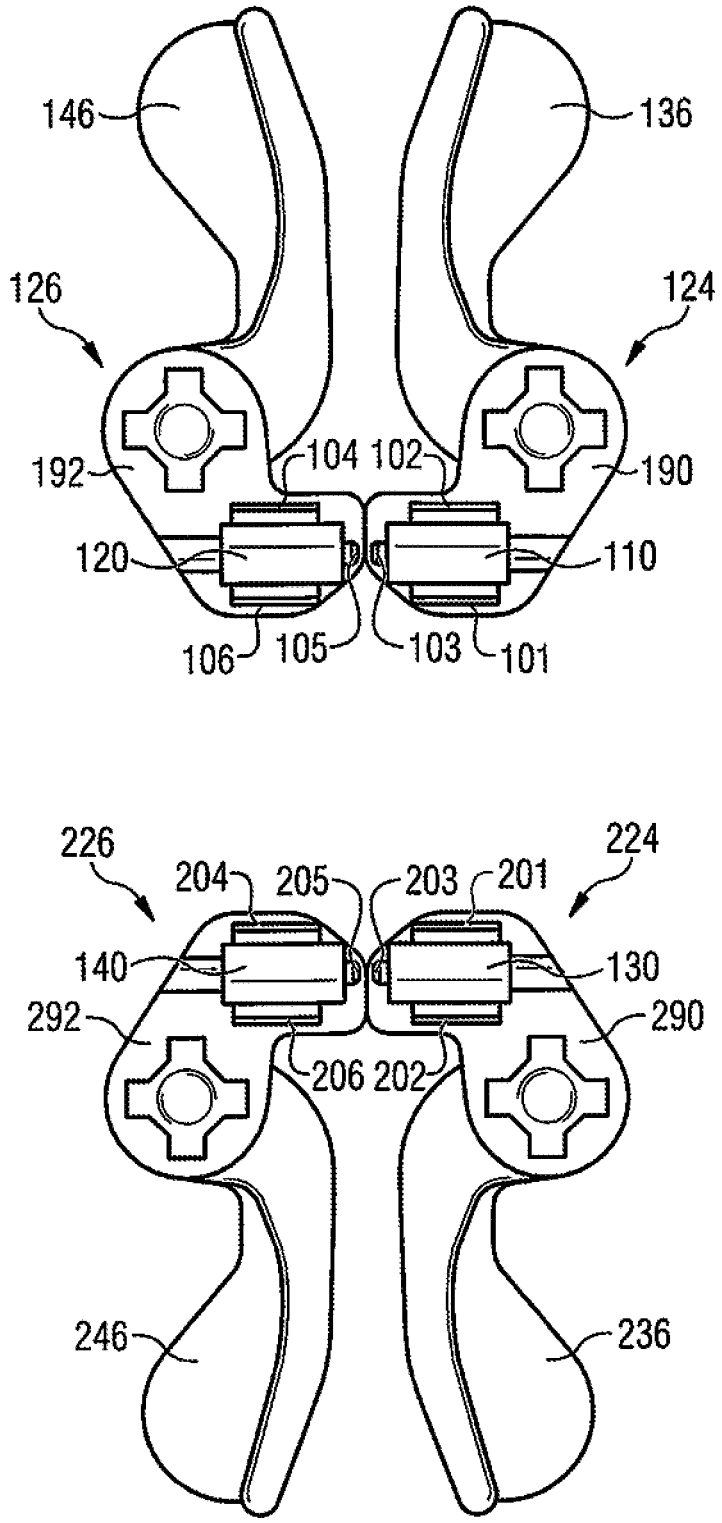
FIG. 7 shows a side view of an arrangement of the guiding elements according to FIG. 6.

FIG. 7 shows a side view of the guiding elements 124, 126, 224, 226 according to FIG. 6 in which the levers 152, 154, 252, 254 are not mounted and in which the guiding elements 124, 126, 224, 226 are in the operating position for guiding the notes of value. The magnets 110, 120, 130, 140 are each snapped into two snap-in elements 101, 102, 104, 106, 201, 202 of the levers 190, 192, 290, 292 and thus firmly connected to the levers 190, 192, 209, 292. Further, on each of the snap-in elements 101, 102, 104, 106, 201, 202, 204, 206 one positioning nose 103, 105, 203, 205 is provided, which guarantees for a correct positioning of the magnets 110, 120, 130, 140 in the snap-in elements 101, 102, 104, 106, 201, 202. Alternatively to the snap-in connection, the magnets 110, 120, 130, 140 may be connected to the levers 190, 192, 290, 292 by a clamp connection and/or an adhesive connection and/or can be cast into the levers 190, 192, 290, 292 and/or be integrally formed with the levers 190, 192, 290, 292 and/or be received in a recess.

Figure 8:
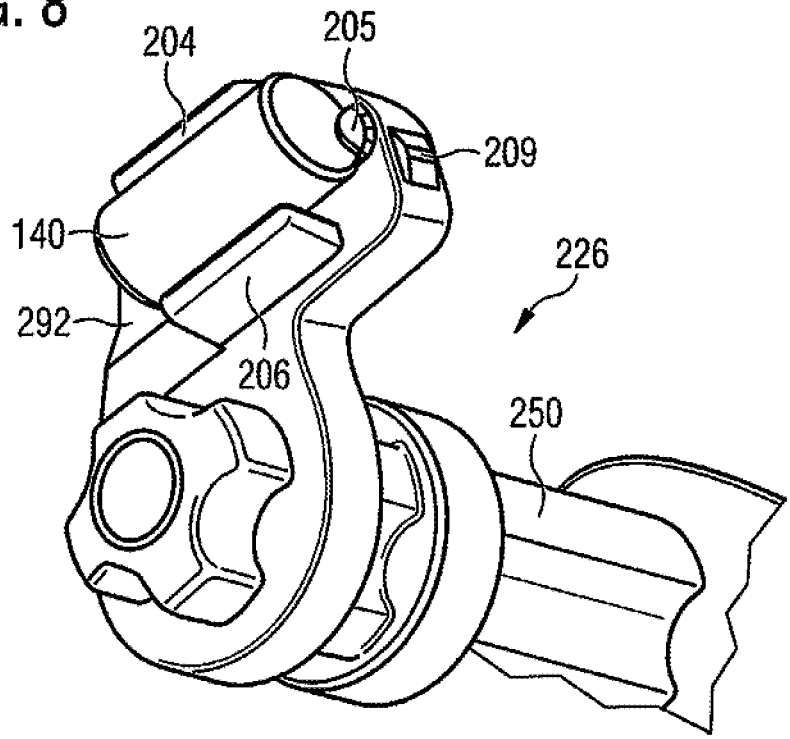
FIG. 8 shows a perspective detailed view of a guiding element according to FIGS. 6 and 7.
Figure 9:
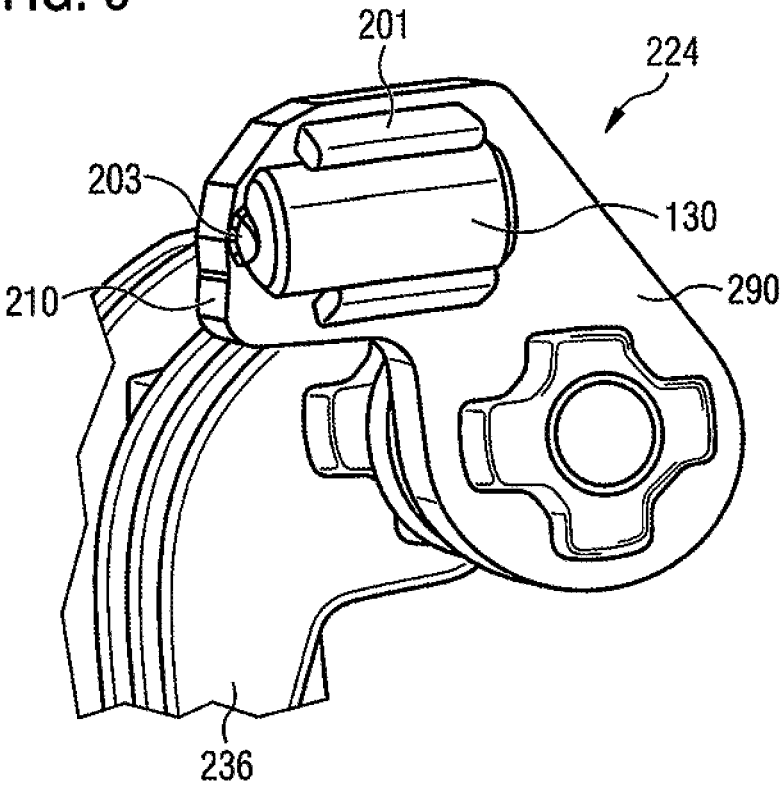
FIG. 9 shows a further perspective detailed view of a guiding element according to FIGS. 6 and 7.

FIG. 8 shows a perspective detailed view of the guiding element 226, and FIG. 9 shows a perspective detailed view of the guiding element 224. In the depictions according to FIGS. 8 and 9 the levers 152, 154, 252, 254 are not mounted on the shafts 132, 150, 232, 250. In particular, the lever 292 includes a first positioning element 209 and the lever 290 includes a second positioning element 210 which is complementary to the first positioning element, which are formed and arranged such that in the operating position of the guiding elements 224 and 226 the positioning element 209 and the positioning element 210 are engaged. The force of this connection acts in addition to the magnetic attractive force of the magnets 130 and 140. A connection established in the same manner is also provided between the levers 190 and 192, between the levers 194 and 196 and between the levers 294 and 296.

Figure 10:
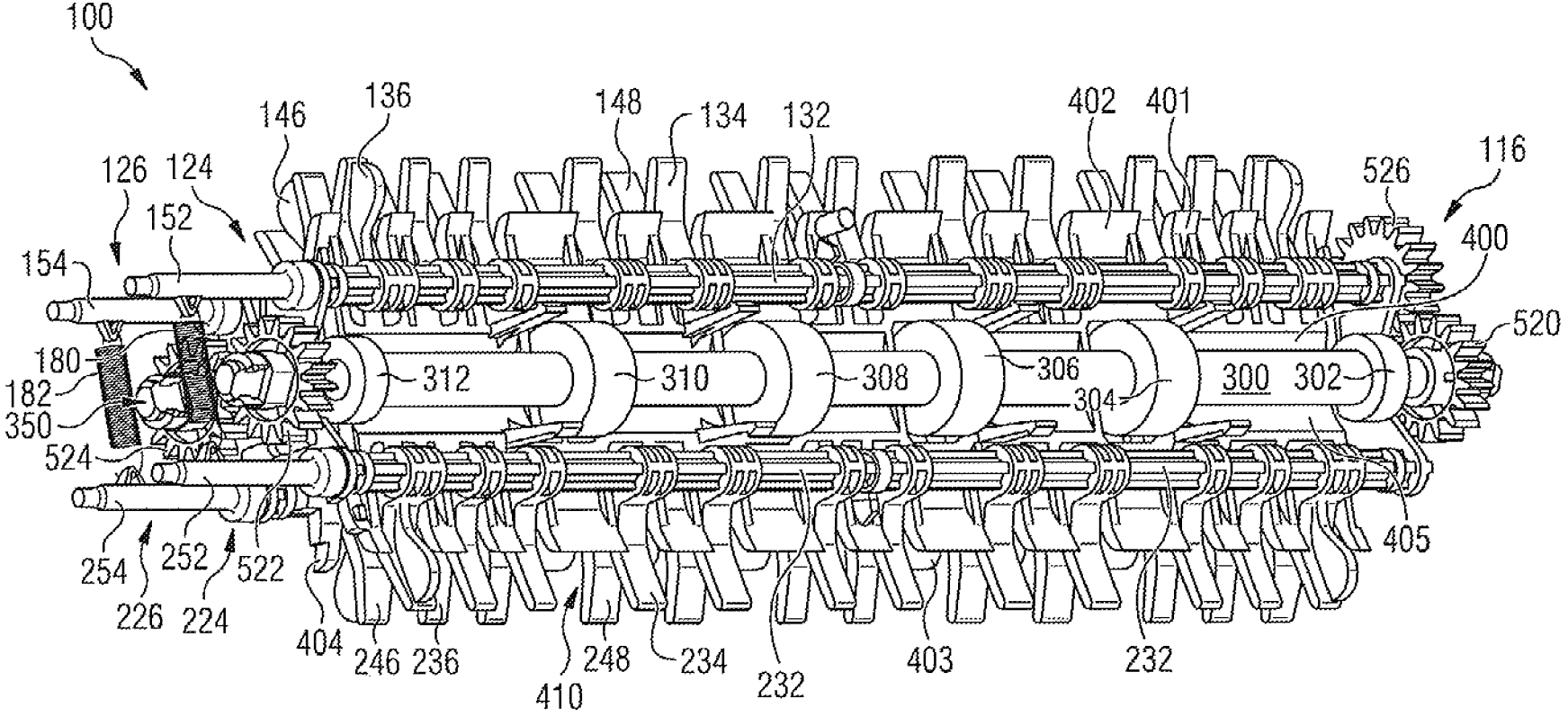
FIG. 10 shows a further perspective view of a transfer module of the device according to FIGS. 4 to 9.
Figure 11:
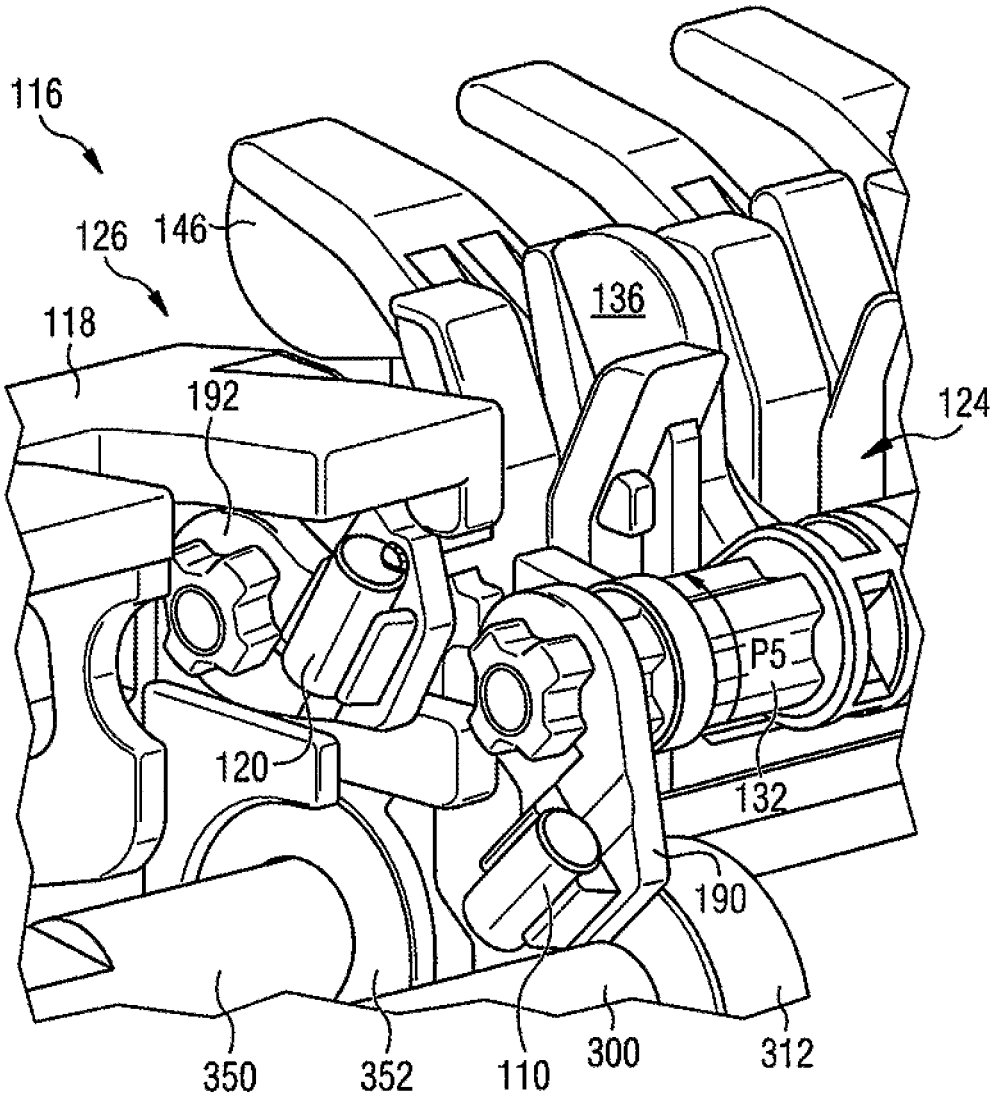
FIG. 11 shows a perspective view of the transfer module according to FIG. 10 in the second operating state.

FIG. 10 shows a perspective view of the transfer module 116 of the device 100. In addition to the guiding elements 124, 126, 224, 226 described in FIGS. 6 to 9, the transfer module 116 includes two oppositely arranged transport shafts, of which in the view of FIG. 10 the first transport shaft 300 with the transport rollers 302 to 312 is visible. A second transport shaft 350 is covered by a sliding element 400. The second transport shaft is arranged opposite to the transport shaft 300 and includes six transport rollers not visible in the illustration according to FIG. 10, which transport rollers are arranged opposite to the transport rollers 302 to 312. In FIG. 11, a transport roller 352 of the transport shaft 350 is shown, which is arranged opposite to the transport roller 312 of the transport shaft 300.

The transport shaft 300 includes at a first end a gearwheel 520 and at a second end a gearwheel 522. The second transport shaft 350 has at a first end a gearwheel 524 and at a second end a second gearwheel 526. The gearwheels 520 and 526 as well as the gearwheels 522 and 524 are engaged so that the first transport shaft 300 and the second transport shaft 350 are drivable by a single drive unit (not illustrated). The drive unit can be a central drive unit of the transfer module or a higher-level drive unit, in particular a main drive unit for note transport.

The transfer module 116 further includes two sliding elements 400, 410 firmly connected to the transfer module 116 and arranged opposite to each other. Each sliding element includes twenty-four sliding fingers, four sliding fingers being exemplarily identified with the reference signs 401 to 404. The sliding fingers 401 to 404 are arranged in the spaces between the guiding fingers 134, 136, 146, 148, 234 236, 246, 248. The sliding fingers 401 to 404 are in particular shorter than the guiding fingers 134, 136, 146, 148, 234, 236, 246, 248 and project neither into the head module 14 nor into the safe 12. Further, the sliding elements 400, 410 include a sliding body, the sliding body of the sliding element 410 being covered by the sliding body 405 of the sliding element 400 in the illustration according to FIG. 10. During the transport of the notes of value in the transfer module 116 the notes of value are safely guided by the guiding elements 124 126, 224, 226 and the sliding elements 400, 410, while the transport of the notes value takes place by the drive of the transport shafts 300, 350 and the contact of the notes of value with the transport rollers 302 to 312.

FIG. 11 shows a perspective view of the transfer module 116 of the device 100 for handling notes of value according to FIG. 10 in a second operating state, in which the head module 14 has been moved relative to the transfer module 116. In the depiction according to FIG. 11 the levers 152, 154 are not mounted on the shafts 132, 150. Here, the guiding fingers 134, 136, 146, 148 have been rotated about the axes of rotation of the shafts 132 and 150 in the direction of the arrow P5 such that they no longer project into the head module 14. Thus, in the second operating state no transport of notes of value in the transfer module 116 is possible. Further, in the second operating state a force is temporarily exerted on the first upper guiding element 124 and the second upper guiding element 126, which acts against the holding force of the springs 180 and 182, against the magnetic attractive force and against the holding force developed by the engagement of the positioning elements 209, 210.

Figure 12:
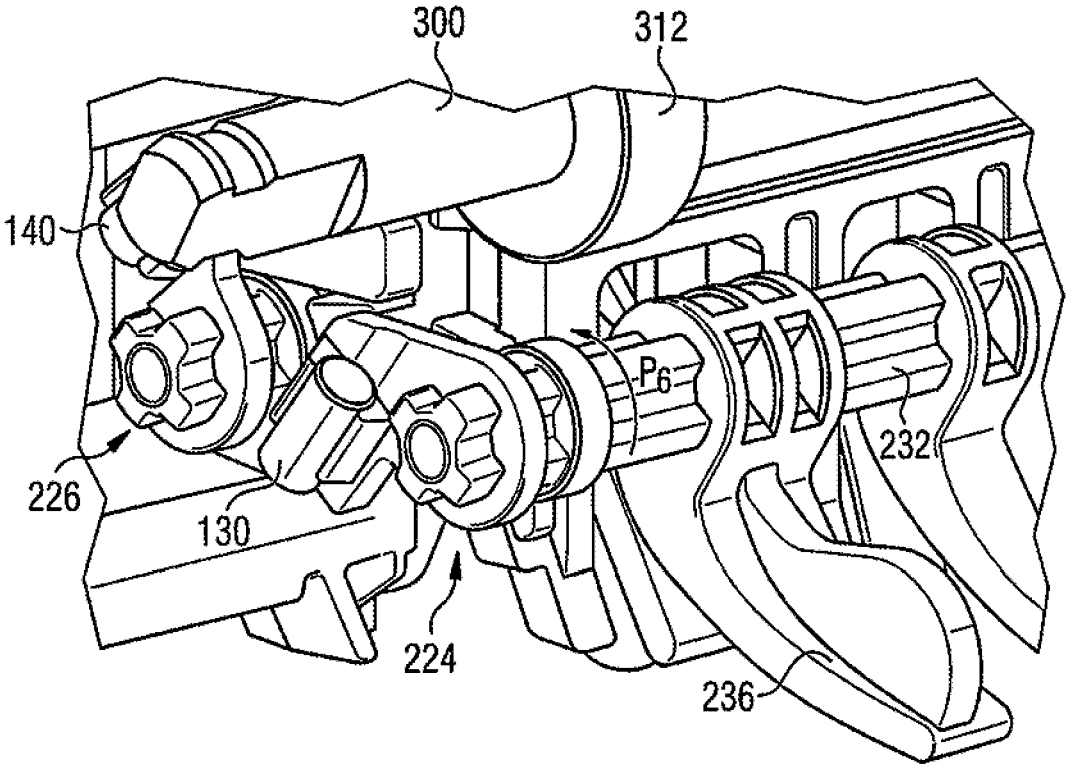
FIG. 12 shows a perspective view of the transfer module according to FIG. 10 in a third operating state.

FIG. 12 shows a perspective view of the transfer module 116 of the device 100 for handling notes of value according to FIG. 10 in a third operating state, in which the safe 12 has been moved relative to the transfer module 116. In the depiction according to FIG. 12 the levers 252, 254 are not mounted on the shafts 232, 250. Here, the guiding fingers 234, 236, 246 248 have been rotated about the axes of rotation of the shafts 232 and 250 in the direction of the arrow P6 such that they no longer project into the safe 12. Thus, in the third operating state no transport of notes of value through the transfer module 116 is possible. Further, in the third operating state a force is temporarily exerted on the first lower guiding element 224 and the second lower guiding element 226, which acts against the holding force of the springs 180 and 182, against the magnetic attractive force and against the holding force of the snap-in connections, and against the holding force developed by the engagement of the positioning elements 209, 210.

In a fourth, non-illustrated operating state, the head module 14 no longer contacts the guiding elements 124, 126 so that they automatically move from the position shown in FIG. 11 into their operating position. In a fifth, non-illustrated operating state, the safe 12 no longer contacts the guiding elements 224, 226 so that they automatically move from their position illustrated in FIG. 12 into their operating position.

While principles and modes of operation have been explained and illustrated with regard to particular embodiments, it must be understood, however, that this may be practiced otherwise than as specifically explained and illustrated without departing from its spirit or scope.

What is claimed is:

1. A device for handling notes of value comprising:

a first module and a second module, the first module and the second module each having a transport mechanism for transporting notes of value, and a third module including a first guiding element and at least a second guiding element for guiding the notes of value, the first guiding element including at least a first magnet and the second guiding element including at least a second magnet or a ferromagnetic material, wherein in at least one operating state of the device, notes of value are guided by guiding elements of the third module during the transport from the first module to the second module and/or from the second module to the first module, wherein in the operating state the guiding elements are oriented in an operating position for guiding the notes of value, and wherein the first magnet and the second magnet or the first magnet and the ferromagnetic material are arranged opposite to each other at least in the operating state, an attractive force acting between the first magnet and the second magnet or the first magnet and the ferromagnetic material.

2. The device according to claim 1 further comprising:

a first elastically deformable element exerting a holding force on the first guiding element for holding the first guiding element in the operating position for guiding the notes of value, and a second elastically deformable element exerting a holding force on the second guiding element for holding the second guiding element in the operating position for guiding the notes of value.

3. The device according to claim 2, where the elastically deformable elements are tension springs.

4. The device according to claim 1, where the first guiding element is arranged so as to be rotatable about a first axis of rotation coinciding with its longitudinal axis, and that the second guiding element is arranged so as to be rotatable about a second axis of rotation coinciding with its longitudinal axis.

5. The device according to claim 1, where at least a portion of the first guiding element oriented in the operating position projects into the first module and/or that at least a portion of the second guiding element oriented in the operating position projects into the first module.

6. The device according to claim 1, where the first magnet is connected to a first lever including a first positioning element or where a first lever including a first positioning element includes the first magnet, and where the second magnet or the ferromagnetic material is connected to a second lever including a second positioning element or where a second lever including a second positioning element is made of ferromagnetic material or where a second lever including a second positioning element is the second magnet, and wherein the first positioning element and the second positioning element are arranged such that in the operating position of the guiding elements, the first and the second positioning element are engaged.

7. The device according to claim 1, where the second module and the third module form a module unit, and where the first module is movable relative to the module unit in at least one direction and/or the module unit is movable relative to the first module in at least one direction, and where upon a relative movement between the first module and the module unit at least a portion of the first guiding element and/or a portion of the second guiding element are rotated about their respective axis of rotation by contacting the first module such that the guiding elements contact at least temporarily a surface of the first module facing the module unit.

8. The device according to claim 7, where the one operating state is a first operating state of the device, and where a further operating state of the device is provided in which the first module and the module unit are moved relative to each other such that no note of value can be transported from the first module into the second module and/or from the second module into the first module, the first guiding element and the second guiding element automatically orient themselves in the operating position in the further operating state of the device.

9. The device according to claim 1, where upon a relative movement between the first module and a module unit formed by the second module and the third module, a force is exerted at least temporarily on the first and/or the second guiding element, which acts against the holding force of an elastically deformable element, against the magnetic attractive force and against the holding force developed by the engagement of positioning elements.

10. The device according to claim 1, where the third module includes a third guiding element and a fourth guiding element, and where in the operating state, at least a portion of the first guiding element and at least a portion of the second guiding element project into the first module and where at least a portion of the third guiding element and at least a portion of the fourth guiding element project into the second module, and where in the operating state of the device, the first guiding element, the second guiding element, the third guide guiding element, and the fourth guiding element are oriented in the operating position.

11. The device according to claim 10, where the third guiding element is arranged to be rotatable about a third axis of rotation coinciding with its longitudinal axis and where the fourth guiding element is arranged to be rotatable about a fourth axis of rotation coinciding with its longitudinal axis.

12. The device according to claim 10, where a third elastically deformable element is provided which exerts a holding force on the third guiding element for holding the third guiding element in the operating position of the guiding elements, and where a fourth elastically deformable element is provided which exerts a holding force onto the fourth guiding element for holding the fourth guiding element in the operating position of the guiding elements, and where the third guiding element includes at least a third magnet and where the fourth guiding element includes at least a fourth magnet or a second ferromagnetic material, and where the third magnet and the fourth magnet or the third magnet and the second ferromagnetic material are arranged opposite to each other at least in the operating state, an attractive force acting between the third magnet and the fourth magnet or the third magnet and the second ferromagnetic material.

13. The device according to claim 12, where the third magnet is connected to a third lever including a third positioning element or where a third lever including a third positioning element is the third magnet, and where the fourth magnet or the ferromagnetic material is connected to a fourth lever including a fourth positioning element, or where a fourth lever including a fourth positioning element is made of a ferromagnetic material or where a fourth lever including the fourth positioning element is the fourth magnet, and where the third positioning element and the fourth positioning element are arranged such that in the operating position the third and the fourth positioning element are engaged.

14. The device according to claim 12, where the first magnet, the second magnet, the third magnet and/or the fourth magnet are permanent magnets.

15. The device according to claim 12, where the first magnet, the second magnet, the third magnet and/or the fourth magnet are electromagnets.

16. The device according to claim 10, where the first module and the third module form a module unit.

17. The device according to claim 16, where the second module is movable relative to the module unit in at least one direction and/or the module unit is movable relative to the second module in at least one direction, and that upon a relative movement between the second module and the module unit at least a portion of the third guiding element and a portion of the fourth guiding element are rotated in the direction of the module unit by contacting the second module such that the third guiding element and the fourth guiding element contact at least temporarily a surface of the second module facing the module unit.

18. The device according to claim 8, where the first guiding element is connected to a first shaft in a rotationally fixed manner, where the second guiding element is connected to a second shaft in a rotationally fixed manner, where the third guiding element is connected to a third shaft in a rotationally fixed manner, and where the fourth guiding element is connected to a fourth shaft in a rotationally fixed manner, and where the first shaft, the second shaft, the third shaft, and the fourth shaft each include an engagement element with which a respective connecting element, in the form of an eyelet of a respective elastic element, engage.

19. The device according to claim 18, where the first elastic element is a tension spring with two connecting elements, the first connecting element engaging with the engagement element of the first shaft, and the second connecting element engaging with the engagement element of the third shaft, and/or where the second elastic element is a tension spring with two connecting elements, the first connecting element engaging with the engagement element of the second shaft and the second connecting element engaging with the engagement element of the fourth shaft.

* * * * *